United States Patent [19]

Anderson et al.

[11] Patent Number: 4,481,494

[45] Date of Patent: Nov. 6, 1984

[54] BI-METAL SNAP DISC OPERATED RELAY

[75] Inventors: Richard M. Anderson, Shelby; Harold F. Snider; Donald J. Schmitt, both of Mansfield, all of Ohio

[73] Assignee: Therm-O-Disc, Incorporated, Mansfield, Ohio

[21] Appl. No.: 462,670

[22] Filed: Jan. 31, 1983

[51] Int. Cl.[3] ..... H01H 37/52

[52] U.S. Cl. ..... 337/95; 337/104; 337/354; 337/370

[58] Field of Search ..... 337/38, 89, 95, 104, 337/370, 40, 354, 96, 101

[56] References Cited

U.S. PATENT DOCUMENTS

| | | | |
|---|---|---|---|
| 2,002,467 | 5/1935 | Blodgett | 337/38 |
| 2,324,161 | 7/1943 | Holmes | 337/40 |
| 2,446,831 | 8/1948 | Hottenroth, Jr. | 337/38 |
| 2,471,924 | 5/1949 | Bolesky | 60/23 |
| 3,534,314 | 10/1970 | Ellengerger | 337/96 |
| 3,582,853 | 6/1971 | Morris | 337/102 |
| 4,105,897 | 8/1978 | Stratton et al. | 307/3 |
| 4,106,007 | 8/1978 | Johnston et al. | 340/310 |
| 4,307,367 | 12/1981 | Mellentin et al. | 337/95 |

*Primary Examiner*—Harold Broome

*Attorney, Agent, or Firm*—Pearne, Gordon, Sessions, McCoy, Granger & Tilberry

[57] ABSTRACT

A thermal relay is disclosed which provides a bi-metal snap disc actuator system. The actuator system includes a central divider of material having relatively low thermal conductivity and a metallic disc cup mounted on each side of the central divider. A bi-metal snap disc is located in each disc cup and a separate heater is provided to respectively heat the discs. The discs are mounted so that they tend to move toward each other at normal environmental temperatures and a bumper is interposed between the discs to cause them to move in with snap action in the unison. The actuator operates two switches. In one embodiment, one switch is normally closed and the other switch is normally open. In another embodiment, both switches are normally open.

18 Claims, 6 Drawing Figures

BI-METAL SNAP DISC OPERATED RELAY

BACKGROUND OF THE INVENTION

This invention relates generally to electrical relays, and more particularly to a novel and improved bimetal snap disc-operated thermal relay.

PRIOR ART

Thermal relays utilizing heaters to operate bimetal snap elements are known. In such devices, the snap element is heated and operates a switch with snap action when the snap element reaches its operating temperature. It is also known to interconnect two snap elements in opposition to provide a compound snap assembly which remains in either of its operative positions independent of ambient temperature. U.S. Pat. Nos. 2,002,467; 2,324,161; 2,446,831; 2,471,924; 3,534,314; 3,582,853; and 4,307,367 are representative of thermal relays generally.

In most devices utilizing two snap elements, a mechanical interconnection is provided to secure the two elements together so that they move in unison. Such mechanical interconnection is undesirable in many instances, since the clamping of the connection to the snap element can adversely affect the calibration of such element.

In the device illustrated in U.S. Pat. No. 3,582,853, supra (assigned to the assignee of this invention), a simple bumper is provided which merely engages the snap elements at its ends and such element is not mechanically connected to the snap elements themselves. In such system, calibration is not adversely affected by the connection between the snap elements, but the device is maintained in its operative condition only so long as the heater is energized.

SUMMARY OF THE INVENTION

There are a number of aspects to this invention. In accordance with one aspect, a snap-acting bimetal operated relay device employing a simple spacer-type disc connector between two discs is operable to remain in either of its operative positions and is operable by two heaters back and forth between such positions.

The illustrated embodiment is particularly suited to remotely connect and disconnect the power service to homes or the like so that service personnel need not go to a service location to perform such operations.

In accordance with another aspect of this invention, an improved relay device is structured to be mounted in a housing between a meter base and a meter, which measures the electrical usage of a dwelling or the like. Such relay is structured to be positioned between the two conductors which must be switched, and so that the housing can be arranged for simple plugging into the meter base and for receiving the plugs of the meter.

In accordance with still another aspect of this invention, the thermal relay operates two switches. In one embodiment one switch is normally open and the other is normally closed. The normally open switch applies a resilient force to the disc assembly in all positions of movement, and therefore does not stall the discs when the device operates. The normally closed switch is arranged to operate in a disc position substantially spaced from the position of operation of the normally open switch, to ensure that both switches operates correctly. Further the position of operation of the normally open switch is selected so that substantial erosion thereof can occur before such switch fails to operate correctly.

In another embodiment both of the switches are normally open and operate simultaneously. In both embodiments, the thermal relay is also structured so that in the event that a severe overcurrent fault condition is encountered, the contacts can blow apart and cause the discs to snap over-center to the switch-open position. This protects the device from permanent damage. Further, in the illustrated system, the device will automatically recycle after such occurrence.

BRIEF DESCRIPTION OF THE DRAWINGS

These and other aspects of this invention are illustrated in the accompanying drawings, and are more fully described in the following description and drawings, wherein:

FIG. 4 is a circuit diagram, illustrating the connection of the thermal relay in a remotely operated service connect-disconnect system for a home or the like;

FIG. 5 is an exploded, schematic view of the installation of the thermal relay in the housing installable between a meter base and a service meter for a home or the like.

DETAILED DESCRIPTION OF THE DRAWINGS

The illustrated embodiments of this invention provide a compact, structurally simple thermal relay capable of connecting and disconnecting relatively high current electrical power circuits. Such embodiments are particularly suited for connecting and disconnecting the power service to dwellings where the service is capable of supplying power at current levels of several hundred amperes.

In such installations, the relay is preferably mounted in the housing, which is installed between the meter and the meter base. Since the power supply to a typical dwelling involves 230 volts single phase power with a center ground, it is necessary to simultaneously switch both power lines. The illustrated embodiments, therefore, provides two separate switches operated by a single switch actuation system.

Figure 1:
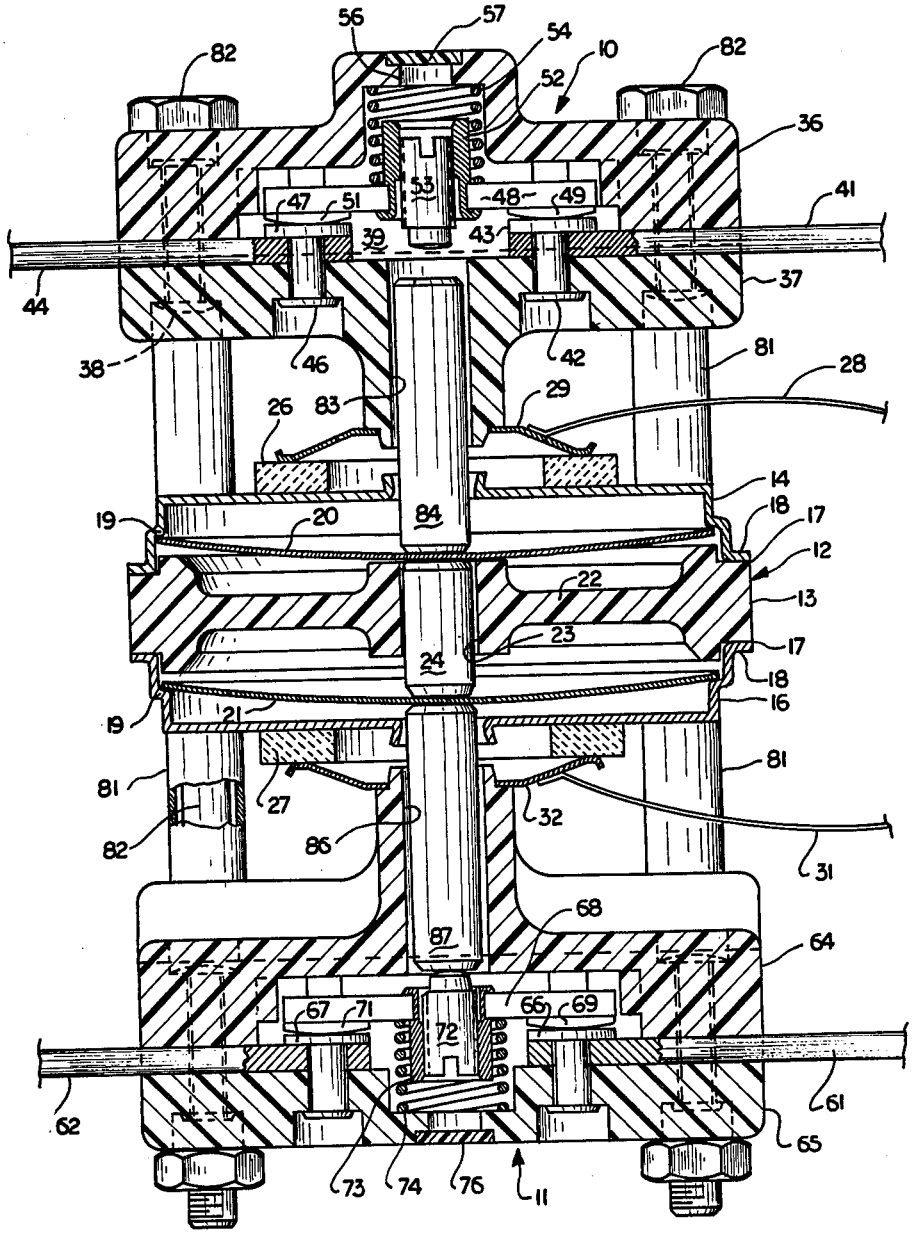
FIG. 1 is a longitudinal section of one preferred embodiment of this invention, illustrating the thermal relay in the switch-closed condition.

Referring to FIG. 1, the relay includes two switch assemblies 10 and 11, respectively, and a central switch actuation assembly 12 located midway between the two switches. The actuation assembly 12 includes a central divider 13 and a pair of opposed and identical metal disc cups 14 and 16. The disc cups 14 and 16 are sheet metal stamped parts and the divider is preferably molded from a phenolic resin which provides relatively low heat conductivity.

The divider is formed with opposed circular shoulders 17 against which associated flanges 18 on the cups are seated to axially and radially locate the cups with respect to the divider. Each cup 14 and 16 is formed with an annular step providing a seat 19 for a bimetal snap disc. A first bimetal snap disc 20 is positioned in the seat 19 of the cup 14 and a second bimetal snap disc 21 is positioned in the seat 19 of the cup 16. The divider is formed with a wall 22 having a central bumper guide opening 23 therein. An elongated bumper or spacer 24 is guided for longitudinal movement and the opening 23 and its ends engage the discs 20 and 21 at their centers. This bumper, as described in detail below, operatively connects the two discs so that they operate in unison and simultaneously snap back and forth between their two operative positions.

Positioned against the first cup 14 is an annular first heater 26 and positioned against the second cup 16 is a similar second annular heater 27. These two heaters 26 and 27 are preferably positive temperature coefficient heaters, normally referred to as PTC heaters, which have a relatively low resistance until they reach a predetermined temperature. Once they reach such temperature, their resistance increases drastically. Therefore, such heaters, when energized, tend to heat rapidly to such predetermined temperature and then remain at such temperature. Therefore, PTC heaters do not tend to overheat, even though they provide a relatively high power for rapid heating up to the predetermined temperature.

Power for the heater 26 is provided through a lead 28 to a terminal clip 29 and through the cup 14. Similarly, power for operating the heater 27 is provided through a lead 31 to a terminal clip 32 and through the cup 16.

The switch assembly 10 provides a two-part body, including an outer body member 36 and an inner body member 37. Both body members 36 and 37 are again preferably molded from a phenolic resin or the like. The two body members 36 and 37 are permanently connected by rivets 38 and cooperate to provide a switch cavity 39. A first power line 41 extends along an opening between the two body members 36 and 37, and is secured at its inner end to the body 37 by a rivet terminal 42. This terminal provides a stationary contact 43 at its inner end. A second power line 44 extends into the cavity between the body members 36 and 37, and is also mounted at its inner end on the body member 37 by a rivet 46. Here again, the rivet 46 provides a stationary terminal 47 at its inner end.

A bridging contact 48 extends between the two fixed contacts 43 and 47, and is provided with movable contacts 49 and 51, which respectively engage such stationary contacts. Centrally mounted on the bridging contact 48 is a tubular, internally threaded element 52 which receives a calibration screw 53. A coil spring 54 biases the bridging element in a normally closed direction so that the switch assembly 10 provides a connection between the two power leads 41 and 44 except when the actuator assembly 12 operates to open the switch. The upper body member 36 is provided with an opening 56 which is aligned with a calibration screw 53 to allow calibration of the switch operation after full assembly. After calibration is complete, the opening 56 is permanently closed by a cover 57, which is cemented in place.

The switch assembly 11 is similar in structure to the switch assembly 10; however, this switch is normally open rather than normally closed. Here again, the switch 11 provides two power lines 61 and 62 which extend into a cavity 63 defined by two molded body members 64 and 65. Stationary contacts 66 and 67 are respectively mounted on the inner ends of the two conductors 61 and 62. A bridging contact 68 provides movable contacts 69 and 71, which respectively engage the fixed contacts 66 and 67 when the bridging contact 68 is operated by the actuator assembly 12 to close the switch 11. A calibration screw 72 is threaded into a tubular element 73 mounted on the bridging contact 68 and a coil spring 74 normally biases the bridging contact toward the switch-open position. Here again, the body 65 is provided with an opening aligned with a calibration screw 72, which is closed by a cover 76 after the switch is properly calibrated.

The two switch assemblies 10 and 11 are mounted on opposite sides of the actuator assembly 12 by means of tubular spacers 81, through which four symmetrically located through bolts 82 extend to clamp the entire assembly together.

The housing member 37 is formed with a bumper guide opening 83 which positions a bumper 84 for longitudinal movement. One end of the bumper 84 engages the side of the disc 20 opposite the bumper 24, and the other end of the bumper 84 is engageable with the calibration screw 53 when the discs snap through from the position of FIG. 1 to the position illustrated in FIG. 2. Such movement causes the bridging contact 81 to be raised, opening the switch assembly 10. Similarly, the housing member 64 is provided with a bumper guide opening 86 which receives and guides another bumper 87 for longitudinal movement. Here again, one end of the bumper 87 engages the side of the disc 21 remote from the bumper 24, and the other end is engageable with the calibration screw 72 to move the bridging contact to the closed position when the discs are in the position of FIG. 1 and to allow the spring 74 to raise the bridging contact 68 and open the switch when the discs snap to the opposite position.

The two discs 20 and 21 are formed of the same material, and are calibrated for operation in their free state at substantially the same snap temperatures. In the illustrated embodiment, each of the discs is calibrated to snap in one direction upon reaching a temperature of about 300° F. and to snap through to the opposite position of stability upon reaching a temperature of about 200° F. The discs are assembled in the device so that they tend to snap toward each other upon reaching the lower operating temperature, and tend to snap in opposite directions away from each other upon reaching the 300° F. operating temperature. Therefore, whenever the discs are at a temperature below 200° F., they both attempt to snap toward each other, but such action is prevented by the central bumper 24. With this structure, the discs remain in either of their positions so long as the discs are at substantially the same temperature, and snap through from one position of stability to the other position of stability only when the temperature of one disc is substantially higher than the temperature of the other disc. When the discs are in the position of FIG. 1, and both of the discs are at a temperature below 200° F., the disc 20 attempts to remain in the illustrated position of curvature, and it holds the disc 21 in its illustrated position even though, in the free state, the disc 21 would assume its opposite position of stability.

When the discs have a temperature differential of substantially 100° F., e.g., when their free snap temperatures are about 200° F. and 300° F., respectively, they create a composite system in which the discs will remain in either of the two positions of stability, but will move back and forth with snap action when the temperature of one disc exceeds the temperature of the other disc by about 100° F. The force differential, however, is additive with the two discs in such condition, so that the available forces for operating the switches are equal to the sum of the forces available from a given disc. For example, if each disc were capable of producing a force differential of about 20 pounds, the combined system including the two discs would be capable of producing a force differential of about 40 pounds.

It should also be understood that the forces of the springs 54 and 74 also affect the force displacement curve of the combined system. The spring 74 exerts a force on the disc in all positions of the disc, but the spring 54 exerts a force on the disc only while the switch 10 is open. Once the switch 10 closes, and the disc continues to move to the position of FIG. 1, contact is not maintained between the bumper 84 and the calibration screw 53 or the disc 20, so the force of the spring 54 is not transmitted to the discs. On the other hand, when the device is in the position of FIG. 2, in which the switch 10 is open, the force of the spring 54 is applied to the discs.

Figure 3:
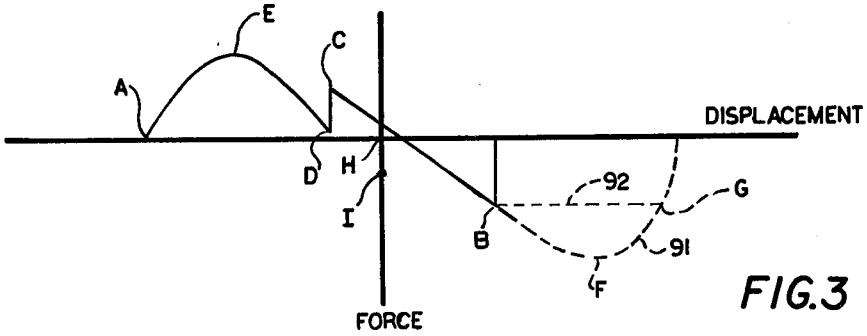
FIG. 3 is a force-versus-displacement curve of the relay illustrated in FIGS. 1 and 2.

FIG. 3 illustrates the force displacement curve for the combined system. Such curve is representative of the curve that might exist, for example, when the discs are stabilized at some ambient temperature such as 100° F., and both discs are at the same temperature.

Figure 2:
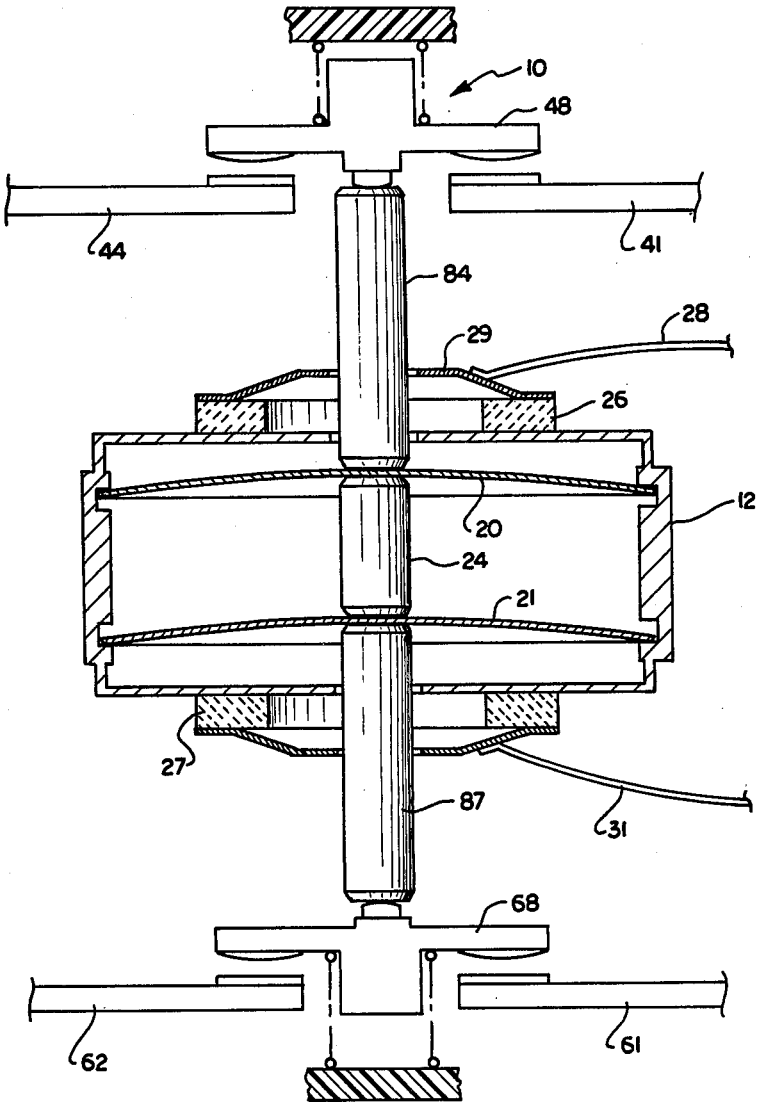
FIG. 2 is a view similar to FIG. 1, but schematically illustrating the positions which the elements assume in the switch-open position.

When the switches are both open, the system will be located to the left of the point E. When the switches are both closed, the system is located at a point B. The portion of the curve to the right beyond the point B illustrated by the dotted line 91 cannot be reached because once the normally open switch 11 closes, the bridging contact 86 is prevented from moving further in a downward position (as illustrated in FIG. 2) and the system is stalled in the position illustrated at B. The operation of the normally closed switch 10 occurs at the displacement position C-D, and the distance C-D represents the force of the spring 54, which is picked up when the switch opens or is dropped off when the switch closes. In order to ensure that the discs do not stall in their snap movement toward the switch closed position when the force of the spring 54 is removed the position of closing of switch 10 is located a sufficient distance down the curve so that the point C is below the snap point E. Since the normally open switch 11 closes after and opens before the normally closed switch 10 it is the switch which actually connects and interupts the greater load. There the switch 11 tends to erode faster than the switch 10. Therefore, the point B should be a substantial distance above the snap point F, so that substantial erosion which can occur between the contacts of the switch 11 before the switch operation will be in the creep zone to the right of the snap point F.

In operation, when it is desired to open the switches 10 and 11 and cause them to move from the switch-closed position of FIG. 1 to the switch-open position of FIG. 2, the heater 26 is energized. This causes the temperature of the disc 20 to increase without a corresponding increase in the temperature of the disc 21. When sufficient difference in temperature exists between the two discs, a point along the force curve at G is reached. Because the disc system has been pulled in by the closure of the switch 11 as illustrated by the line 92, the system becomes unstable and the discs commence to move toward the switch-open position with snap action. This causes the normally open switch 11 to immediately open as the two discs commence to move with snap action toward their opposite position of curvature. When sufficient displacement has occurred to take up the clearance between the bumper 84 and the calibration screw 53, the point C is reached on the curve and the switch 10 commences to open. The system then reaches stability at a location beyond the snap point E on the curve. The heater 26 may then be shut off and discs will remain in the switch open position even when the temperatures of the discs equalize.

Thereafter, when it is desired to close the switches, the heater 27 is energized, which causes the disc 21 to be heated to a temperature higher than the disc 20. As such heating occurs, the system creeps up along the forced displacement curve until the point E is reached and the system again becomes unstable. The discs then commence to move with snap action toward the closed position of FIG. 1. After a small amount of movement, the switch 10 closes at the point D, causing the force of the spring 52 to be removed from the disc system itself. This causes a jump in the curve to the point C, and continued movement of the disc occurs between the points C and B, at which time the normally open switch 11 is closed stalling the system. Here again, the heater 27 may then be turned off and the two discs remain in the switch closed position where they return to an equal temperature which is ambient temperature.

In practice, it is desirable to establish a substantially symmetrical system in which the line B-C crosses the displacement and force lines at a point close to their intersection at H. When the intersection of the line B-C is close to H, the system is substantially symmetrical and approximately the same amount of force is available for operating each of the two switches, and the point B can be located well below the intersection H and well above the snap point F. If the two discs are identical in calibration in that they both have identical free state operating temperatures, the force displacement intersection would occur at about the point I, below the point H. In such situation, the displacement of the curve of the two discs themselves operating in unison caused by the forces of the springs 54 and 74 would result in a system in which the available force for operating the normally open switch 11 would be substantially smaller than the available force for the operation of normally closed switch 10 and the point B would have to be located close to the snap point F. Since it is desirable to locate the point B a substantial distance above the point F to allow for erosion, it is therefore desirable to arrange the system so that the intersection at H is close to the line B-C. This is accomplished by utilizing discs in which the upper disc 20 has free state operating temperatures slightly higher than the free state operating temperature of the disc 21. Therefore, it is preferred to provide the disc 20 with free state operating temperatures higher than the free state operating temperatures of the disc 21 by an amount sufficient to cause the line B-C to pass close to the intersection H. It is, however, within the broad scope of this invention to provide devices in which the operating temperatures of the discs 20 and 21 are virtually the same.

As described above, the discs 20 and 21 are both calibrated to have operating temperatures above the ambient temperatures which are expected to be encountered so that the bumper 24 is always in compression. In such an installation, the discs are positioned in the device so that they tend to move toward the center on decreasing temperature. It is also possible to use discs which have operating temperatures below the expected ambient temperature, and in such instance, they are installed in a position in which they would tend to move toward the center on raising temperature so as to always maintain the bumper 24 in compression.

Figure 4:
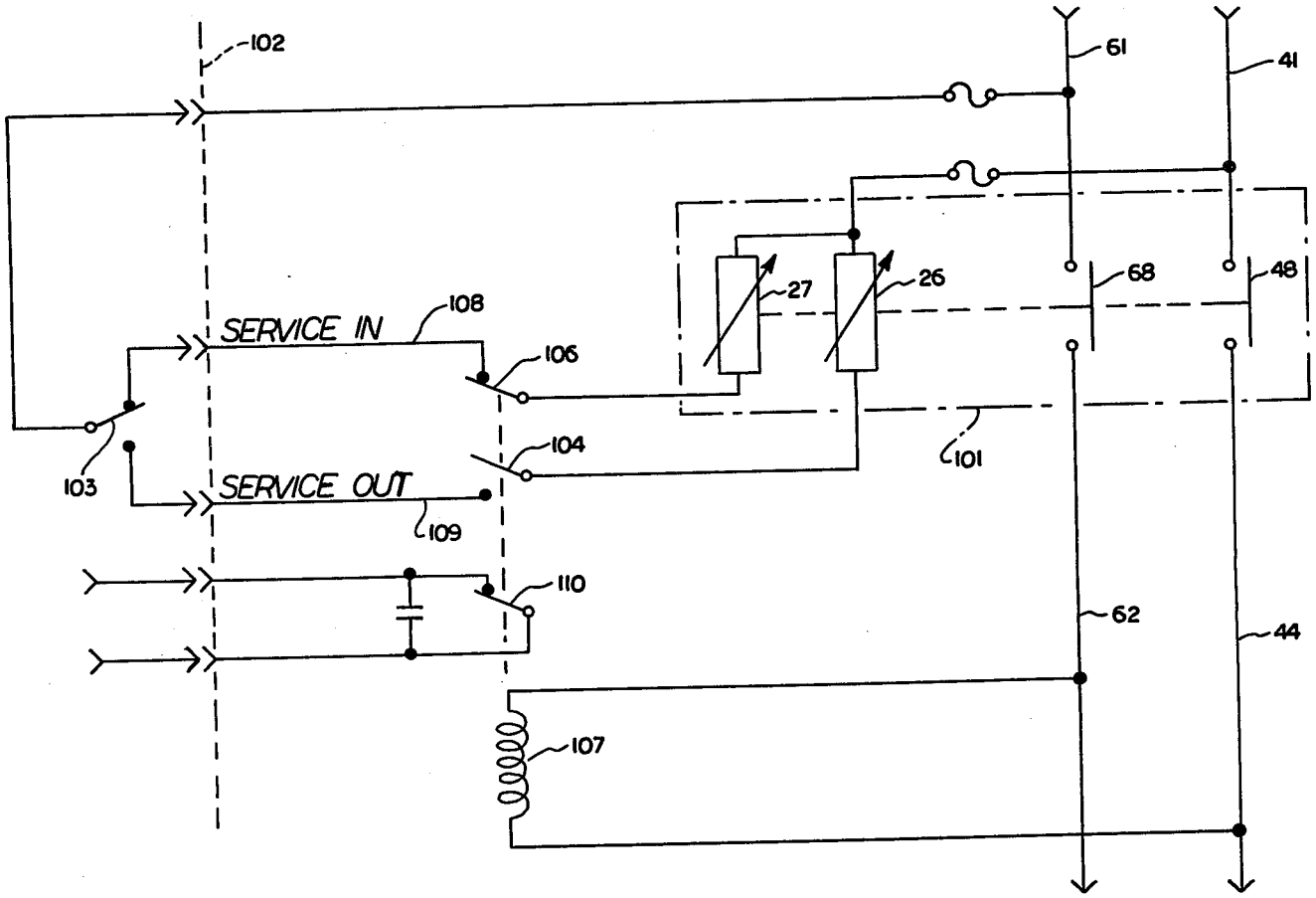

FIG. 4 schematically illustrates one circuit which may be used to operate the thermal relay described above for connecting and disconnecting the service to a dwelling. The dotted box 101 encloses the electrical components of the relay. Power is supplied to the system through the leads 41 and 61, and is delivered to the dwelling through the leads 44 and 62. The first bridging contact 48 connects or disconnects the lines 41 and 44, and the second bridging contact 68 connects the lines 61 and 62.

The portion of the circuit indicated to the left of the dotted line 102 in FIG. 4 forms no part of this invention, but is intended to represent a system permitting a signal passing along the line 61 generated at a power station or distribution station to create the operation of a selector switch 103. Such system may, for example, involve an apparatus for transmitting intelligence over a carrier wave of the type illustrated in U.S. Pat. Nos. 4,105,897 or 4,106,007. However, other forms of signal creating systems may be utilized.

The two heaters 26 and 27 are connected on one side to the power line 41 and are connected on their other side through the contacts 104 and 106, respectively, to the switch 103. The two contacts 104 and 106 are operated by a solenoid-type relay having a coil 107 connected across the two lines 44 and 62. When the connect-disconnect relay 101 is open, as illustrated in FIG. 4, the coil 107 is de-energized and the switches 104, 106 move to the illustrated position. In such position, the switch contact 106 is closed and the contact 104 is open. If a signal is transmitted to the system, indicating that service should be connected, the switch 103 assumes the position illustrated in FIG. 4, in which power is supplied through a line 108 and the contacts 106 to energize the heater 27. As soon as the heater 27 raises the temperature of the associated disc 21 to the required difference in temperature between the disc 21 and the disc 20, the discs snap through, closing the bridging contacts 48 and 68 to supply service to the lines 44 and 46. When this occurs, the coil 107 is energized, causing the relay contacts 106 to open and the contact 104 to close. This de-energizes the heater 27 and the system remains connected until the switch 103 is operated by a disconnect signal to operate the switch 103 to its other position. In the other operative position, the switch 103 connects power to the heater 26 through the line 109 until the heater 26 operates the thermal relay to disconnect the lines 44 and 62, at which time the relay drops out, opening the contact 104 to again de-energize the heater 26. Generally, the circuit includes a signal contact 110 on the relay which creates a signal indicating that the power is or is not connected.

Figure 5:
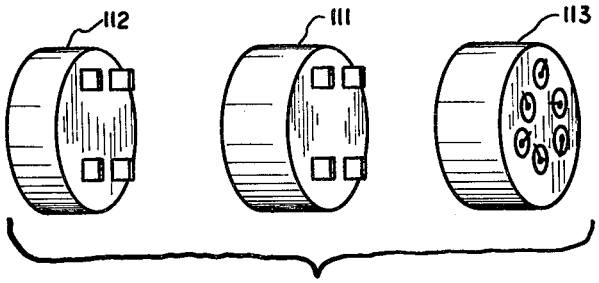

FIG. 5 schematically illustrates a preferred installation of a thermal relay in accordance with this invention. In such an installation, the thermal relay is mounted in a housing 111, which plugs into a meter base 112, and which is arranged to receive the plug of a typical dwelling meter 113. In most instances, the spacing between the supply lines in the meter base is equal to the spacing between the supply leads 44 and 61, so that the thermal device can be in alignment with the power leads, as illustrated. In such an installation, it is not necessary to divert the conductors, and they are preferably located within the housing, the meter base, and the meter at a spacing equal to the spacing between the conductors entering and leaving the switches of the thermal relay.

Figure 6:
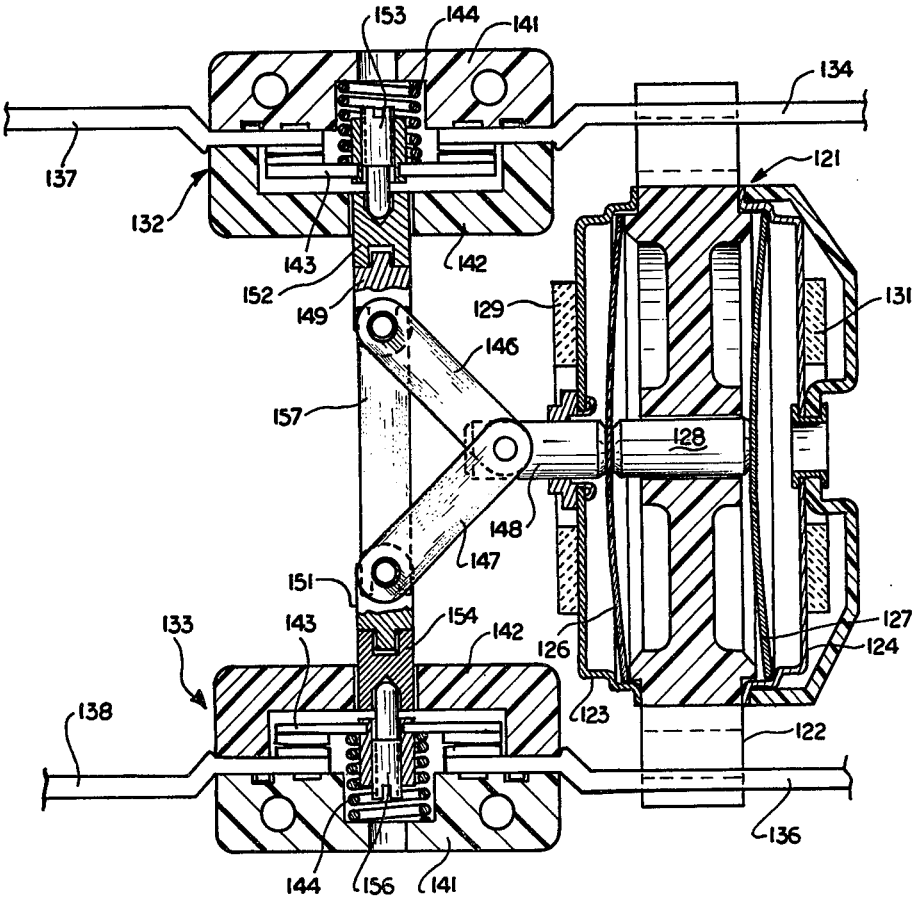
FIG. 6 is a schematic section of a second embodiment of this invention.

FIG. 6 schematically illustrates a second embodiment in which both of the switches ae normally open switches and operate substantially simultaneously. Here again in this embodiment an actuation unit 121 includes a divider 122 and a pair of metallic disc cups 123 and 124. A first disc 126 is seated within the disc cup 123 and a second disc 127 is seated in the other disc cup 124. The two discs are positioned in opposition so that when they are at the same ambient temperature, they both tend to move toward each other, as discussed above. A bumper 128 is positioned between the discs so that they operate in unison.

The first heater 129 is operable to heat the disc 126 without corresponding heating of the other disc 127, and a second heater 131 is operable to heat the disc 127 without corresponding heating of the disc 126.

A pair of identical but opposite switch assemblies 132 and 133 are respectively connected to connect and disconnect the supply conductors 134 and 136 and their associated conductors 137 and 138. Each switch assembly includes a pair of switch housing members 141 and 142, which define switch cavities enclosing a bridging contact 143. A spring 144 urges the associated bridging contact 143 toward the normally open position. A linkage connects each of the switches to the actuator unit 121. Such linkage includes a pair of links 146 and 147, which are pivoted at one end to a bumper 148 and at their other ends to pushers 149 and 151, respectively. The pusher 149 is operable through a connector 152 and a calibration screw 153 to overcome the action of the spring and move the bridging contact of the switch 132 to the closed position illustrated.

Similarly, the pusher 151 is operable through a connector 154 and a calibration screw 156 to move the bridging contact 143 of the switch 133 to the closed position. A guide member 157 is mounted on the base and formed with grooved ends which embrace the adjacent pivots of the links 146 and 147 to ensure that the respective pushers 149 and 151 move along a straight line.

In the structure of the embodiment of FIG. 6, the two switches operate substantially simultaneously rather than in sequence, as in the embodiment of FIG. 1. The operation of the actuator 121, however, is substantially identical to the operation of the actuator 12 of the embodiment of FIG. 1 in that heating of one disc creates a temperature differential between the two discs and causes the system to move with snap action from one position of stability to the other position of stability. For example, operation of the heater 131 raises the temperature of the disc 127 above the temperature of the disc 126 and operates to move the two discs to the right as viewed in FIG. 6, causing the switches to open. Conversely, operation of the heater 129 operates the actuator to cause switch closure.

Both embodiments provide calibration screws which permit very accurate location of the operating positions of the switch with respect to the actuator and with respect to each other after the device is fully assembled. This permits accurate manufacture without requiring excessively close tolerances of the elements of the device.

It is possible, for example when the circuits controlled by the relay encounter a severe short, for the relay to be exposed to very high current conditions. Such high current conditions can involve momentary current flows of several thousand amperes. Under such conditions, an electrodynamic force of repulsion exists between the contacts of the switches, tending to blow the switches open.

In the embodiment of FIG. 1, this force, if sufficiently high, will overcome the force of the spring 54 and cause the bridging contact 48 to open. Such movement of the contact 48, however, does not have any effect on the discs 20 and 21. However, if the electrodynamic force on the contact 68, in combination with the force of the spring 74, is sufficiently great, the contact 68 will blow open and will push the discs over-center to the switch-open position. In such an event, the relay will remain in the switch-open position to prevent welding of the contacts. Such operation, when excessive current flows are encountered, operate to prevent welding of the contacts, and therefore prevent relay failure.

If the relay is installed in a system having a circuit as illustrated in FIG. 4, when it is caused to open as a result of excessive current flow, the opening of the switches 48 and 68 will cause the relay 107 to drop out, closing the contact 106 and opening the contact 104. This automatically causes the heater 27 to be energized, and therefore causes an automatic recycling of the system. Under such conditions, the thermal relay will again snap through to the closed condition when the heater 27 has raised the temperature of the disc 21 a sufficient amount above the temperature of the disc 20.

Since the fuses in a normal electrical system of a dwelling (not illustrated) will have then normally disconnected the short, recycling of the thermal relay in that event will permit the reconnection of the service and the relay will be capable of continued normal operation in spite of the excessive overcurrent condition, which would have otherwise caused welding of the contacts and relay failure.

A similar operation occurs in the embodiment of FIG. 6, but in that embodiment the electrodynamic force tending to blow open both switches is transmitted to the discs to push them over-center to the relay-open condition.

The electrodynamic force developed is a direct function of the amount of current flow. Also, the force required to push the disc through to the switch-open position is determined by the discs themselves, in combination with the springs of the normally open switch or switches. In other words, the force tending to retain the normally open contacts in the contact-closed position is equal to the force produced by the two discs minus the force of the spring tending to urge the normally open contact toward its open condition.

By properly selecting the discs and the springs of the normally open switches, it is possible to provide a relay which will trip over to the switch-open position when a predetermined overcurrent flow condition occurs. For example, if it is desired to provide a relay which blows open at a lower current level, the system is arranged to provide a smaller contact force on the normally open switch or switches. Conversely, if it is desired to provide a relay which will not blow open until a higher current flow condition is encountered, the device is structured to provide a higher force level on the normally open switch or switches when they are in the closed position.

With this invention, a very compact, relatively simple relay system may be utilized to connect and disconnect circuits which carry substantial current. Because of the additive effect of the forces made available by the two discs working in unison, as described above, it is possible to operate heavy switches capable of handling heavy current loads of the type encountered in the illustrated installation. Further, such heavy switches are protected against excessive arcing by the very rapid operation achieved with bimetal snap discs.

Although preferred embodiments of this invention have been shown and described, it should be understood that various modifications and rearrangements of the parts may be resorted to without departing from the scope of the invention as disclosed and claimed herein.

What is claimed is:

1. A thermal relay comprising a body, first and second snap acting elements each operable in a free state to move with snap action from a first position of stability to a second position of stability upon reaching a second predetermined temperature and to move back to said first position of stability upon reaching a first predetermined temperature, said first and second predetermined temperatures of said first snap element being substantially equal to said first and second predetermined temperatures of said second snap element, said predetermined temperatures being substantially above the environmental temperature in which said relay is intended to operate, said elements being mounted on said body so that they tend to move toward each other upon moving to said first position of stability, an elongated bumper positioned in said body between said elements and engaging at its ends said elements to maintain them in the same position with respect to each other and cause them to simultaneously snap between their two positions of stability, said snap elements exerting a compressive force on said bumper in all conditions of normal operation of said relay, said bumper being free of constraints resisting movement of said snap elements in the directions away from each other, a first heater being operable to heat said first element without corresponding heating of said second element and operable to cause said elements to snap in one direction in unison, a second heater operable to heat said second element without corresponding heating of said first element and operating to cause said elements to move in a direction opposite to said one direction in unison, and switch means operated in response to snap movement of said elements.

2. A thermal relay comprising a body, a pair of bimetal snap elements mounted on said body, said snap elements in their free state being operable to snap back and forth between two positions of stability upon reaching similar first and second predetermined temperatures, means interposed between said snap elements causing them to snap in unison under normal operating conditions, a heater associated with each snap element operable to heat an associated snap element without corresponding heating of the other snap element, operation of one heater causing said snap elements to snap in unison in one direction and operation of the other heater causing said snap elements to snap in unison in the opposite direction, a pair of switches connected to said snap elements opened in response to movement of said snap elements in one direction and closed in response to movement of said snap elements in said other direction, at least one of said switches operating when closed to limit movement of said snap elements in said other direction beyond a predetermined position, said predetermined position being spaced a sufficient distance from the position to which said snap elements would otherwise move in said other direction to permit substantial erosion of said one switch without causing said one switch to fail to open with snap movement.

3. A thermal relay as set forth in claim 2, wherein said one switch is a normally open switch and said one switch opens before the other of said switches and closes after the other of said switches.

4. A thermal relay as set forth in claim 3, wherein said other switch is a normally closed switch, said switches are located on opposite sides of said snap elements, and an elongated bumper is positioned between each of said switches and the adjacent of said snap elements, said bumpers operating the associated switches in response to movement of said snap elements.

5. A thermal relay as set forth in claim 4, wherein said bumpers engage but are not connected to the adjacent of said snap elements and each switch provides a movable contact resiliently urged in a direction toward said snap elements.

6. A thermal relay as set forth in claim 3 wherein the free state operating temperature of one snap element differs from the free state operating temperature of the other snap element by an amount which causes the force displacement curve of the relay system to be substantially symmetrical.

7. A thermal relay as set forth in claim 3 wherein adjustable calibration means are provided for locating the operating position of each switch with respect to the snap movement of said snap elements.

8. A thermal relay as set forth in claim 2, wherein both of said switches are normally open switches, said switches being operable to control current flow through a circuit and being positioned so that electrodynamic forces tending to cause said switches to open are transmitted to said snap elements and are operable to snap said snap elements to a switch-open condition when a predetermined current flow condition occurs.

9. A thermal relay as set forth in claim 2, wherein electrodynamic forces on said one of said switches tending to cause it to open are transmitted to said snap elements and are operable to move said snap elements to a switch-open position when a predetermined flow condition occurs.

10. A thermal relay as set forth in claim 9, wherein said relay is connected in a circuit in which it automatically recycles after it opens in response to said predetermined current flow.

11. A thermal relay comprising a body, a pair of bimetal snap elements mounted on said body, said snap elements in their free state being operable to snap back and forth between two positions of stability upon reaching substantially similar first and second predetermined temperatures, means interposed between said snap elements causing them to snap in unison under normal operating conditions, a heater associated with each snap element operable to heat an associated snap element without corresponding heating of the other snap element, operation of one heater causing said snap elements to snap in unison in one direction and operation of the other of said heaters causing said snap elements to snap in unison in the opposite direction, a pair of switches connected to said snap elements opened in response to movement of said snap elements in one direction and closed in response to movement of said snap elements in the other direction, said switches being adapted to be installed in a circuit which is sometimes subjected to high surge overloads, said switches being structured so that the electrodynamic forces caused by current flow are transmitted to said snap elements and cause movement of said snap elements to a switch-open position upon being exposed to a predetermined overcurrent condition, said snap elements thereafter remaining in said switch-open position until recycled.

12. A thermal relay comprising an actuator assembly including a central divider formed of a material having a relatively low heat conductivity, a metal cup mounted on each side of said divider, each cup providing a disc seat, a bimetal snap disc mounted on each disc seat separated by said divider, said discs each being operable in its free state to snap back and forth between two positions of stability upon reaching similar predetermined temperatures, said divider providing a central guide opening, a bumper in said guide opening engaging a snap disc at each end, a separate heater mounted on each cup operable to heat the associated disc without corresponding heating of the other disc, said discs being positioned so that they tend to move toward each other at all normal environmental temperatures normally encountered, said bumper operating to cause said discs to move in unison back and forth between said positions of stability when said heaters are operated, and switch means operated in response to snap movement of said disc.

13. A thermal relay as set forth in claim 12, wherein said predetermined temperatures are higher than the temperatures normally encountered in the environment thereof.

14. A thermal relay as set forth in claim 12, wherein said switch means include a pair of switches with one mounted on each side of said actuator assembly, each switch including a switch body, a movable contact, and a bumper extending between its movable contact and the adjacent of said discs, said bumper engaging said disc while being free of any connection with said disc.

15. A thermal relay as set forth in claim 14, wherein said switches and actuator assembly are secured together by fastening means which extend through said switches and said actuator assembly.

16. A thermal relay as set forth in claim 12, wherein two switches are connected for operation by said actuator assembly, said switches both normally being in the same position and being movable to their other position by said actuator assembly.

17. A thermal relay as set forth in claim 16, wherein both of said switches are normally open, said switches being positioned in spaced relationship and moving in opposite directions to their closed positions.

18. A thermal relay as set forth in claim 12, wherein said thermal relay is adapted to be installed between a meter and a meter base of a power supply system.

* * * * *